US005576172A

United States Patent [19]

Olm et al.

[11] Patent Number: 5,576,172

[45] Date of Patent: Nov. 19, 1996

[54] ELEVATED IODIDE SURFACE LAMINAE TABULAR GRAIN EMULSIONS

[75] Inventors: Myra T. Olm, Webster; Roger A. Bryant, Rochester; Elizabeth K. Lelental, Rochester; Sharon Gould, Rochester; Sherrill A. Puckett, Rochester, all of N.Y.

[73] Assignee: Eastman Kodak Company, Rochester, N.Y.

[21] Appl. No.: 442,232

[22] Filed: May 15, 1995

[51] Int. Cl.[6] ..... G03C 1/035; G03C 1/09

[52] U.S. Cl. ..... 430/567; 430/604; 430/605

[58] Field of Search ..... 430/605, 567, 430/604

[56] References Cited

U.S. PATENT DOCUMENTS

| | | | |
|---|---|---|---|
| 4,433,048 | 2/1984 | Solberg et al. | 430/434 |
| 4,434,226 | 2/1984 | Wilgus et al. | 430/567 |
| 4,439,520 | 3/1984 | Kofron et al. | 430/434 |
| 4,937,180 | 6/1990 | Marchetti et al. | 430/605 |
| 5,061,616 | 10/1991 | Piggin et al. | 430/569 |
| 5,164,292 | 11/1992 | Johnson et al. | 430/569 |
| 5,268,264 | 12/1993 | Marchetti et al. | 430/605 |

OTHER PUBLICATIONS

*Research Disclosure* vol. 365, Sep. 1994, Item 36544, Section I.

*Research Disclosure* vol. 367, Nov. 1994, Item 36736.

*Primary Examiner*—Mark F. Huff

*Attorney, Agent, or Firm*—Carl O. Thomas

[57] ABSTRACT

A tabular grain emulsion is disclosed that combines increased speed, reduced low intensity reciprocity failure, and low levels of pressure sensitivity. The tabular grains containing greater than 70 mole percent bromide and laminae located adjacent the {111} major faces each having a thickness of less than 35 nanometers and containing at least 1 mole percent higher iodide than a host portion of the tabular grains on which they are deposited. The tabular grains contain an iridium dopant capable of reducing low intensity failure in one interior grain portion and a Group 8 speed enhancing dopant present in a concentration of from 20 to 300 molar parts per million in another interior grain portion separated from the iridium containing grain portion by at least 10 percent of the silver forming the grain structure.

9 Claims, No Drawings

ELEVATED IODIDE SURFACE LAMINAE TABULAR GRAIN EMULSIONS

FIELD OF THE INVENTION

The invention relates to photography. More specifically, the invention relates to radiation-sensitive silver halide photographic emulsions.

DEFINITIONS

The term "tabular grain" refers to a silver halide grain containing two parallel major faces and having an aspect ratio of at least 2.

The term "tabular grain emulsion" refers to an emulsion in which greater than 50 percent of total grain projected area is accounted for by tabular grains.

The term "parallel major faces" refers to two parallel faces clearly larger than any remaining face of a tabular grain.

The term "aspect ratio" refers to the ratio of tabular grain equivalent circular diameter (ECD) divided by tabular grain thickness (t).

The term "ECD" refers to the diameter of a circle having an area equal to the projected area of a silver halide grain.

In referring to silver halide grains and emulsions containing two or more halides, the halides are named in order of ascending concentrations.

The term "high bromide" as applied to grains and emulsions indicates a bromide concentration of at least 70 mole percent, based on silver.

The term "low intensity reciprocity failure" is employed herein to indicate speed variances between emulsions receiving the same exposure, but over differing time periods ranging from 1/1000th second to 1 second. When the law of photographic reciprocity is satisfied (i.e., there is no reciprocity failure), the speed of a photographic emulsion remains the same for all equal products of I ×ti produced by varied values of I and ti, where I is exposure intensity and ti is exposure time.

All references to the periodic table of elements are based on the format adopted by the American Chemical Society, published in the Feb. 4, 1985, issue of the *Chemical and Engineering News.*

*Research Disclosure* is published by Kenneth Mason Publications, Ltd., Dudley House, 12 North St., Emsworth, Hampshire P010 7DQ, England.

BACKGROUND

Kofron et al U.S. Pat. No. 4,439,520 ushered in the current era of high performance silver halide photography. Kofron et al disclosed and demonstrated striking photographic advantages for chemically and spectrally sensitized tabular grain emulsions in which tabular grains having an ECD of at least 0.6 μm and a thickness of less than 0.3 μm exhibit an average aspect ratio of greater than 8 and account for greater than 50 percent of total grain projected area. In the numerous emulsions demonstrated one or more of these numerical parameters often far exceeded the stated requirements. Kofron et al recognized that the chemically and spectrally sensitized emulsions disclosed in one or more of their various forms would be useful in color photography and in black-and-white photography (including indirect radiography). Spectral sensitizations in all portions of the visible spectrum and at longer wavelengths were addressed as well as orthochromatic and panchromatic spectral sensitizations for black-and-white imaging applications. Kofron et al employed combinations of one or more spectral sensitizing dyes along with middle chalcogen (e.g., sulfur) and/or noble metal (e.g., gold) chemical sensitizations, although still other, conventional sensitizations, such as reduction sensitization were also disclosed. Subsequently the art has grouped with these outstanding tabular grains those having lower mean ECD's and lower average aspect ratios.

The overwhelming majority of camera speed tabular grain emulsions contain at least 70 mole percent bromide, based on total silver. The inclusion of at least low levels of iodide is known to improve further the speed-granularity relationships of tabular grain emulsions. Kofron et al, Wilgus et al U.S. Pat. No. 4,434,226 and Solberg et al U.S. Pat. No. 4,433,048 demonstrate speed-granularity relationships of silver iodobromide tabular grain emulsions.

Solberg et al as well as Piggin et al U.S. Pat. Nos. 5,061,609 and 5,061,616 disclose high bromide tabular grain emulsions in which higher levels of iodide are present in laminae having a thickness of less than 35 nm forming the major faces of the tabular grains. Solberg et al demonstrates that this structure can contribute to increasing photographic speed without increasing granularity. Piggin et al demonstrates that these laminae can reduce the susceptibility of tabular grain emulsions to varying photographic response as a function of the localized application of pressure (e.g., kinking or bending).

Johnson et al U.S. Pat. No. 5,164,292 discloses that speed losses attributable to incorporation of iridium dopants in tabular grain emulsions to reduce low intensity reciprocity failure can be offset by the incorporation of selenium as a dopant. When the tabular grains have higher iodide surface laminae, the dopants are compatible with retaining low levels of pressure sensitivity.

The utility of Group 8 (Fe, Ru, Os) metals to enhance speed is disclosed in *Research Disclosure,* Vol. 365, September 1994, Item 36544, Section I. Emulsion grains and their preparation, D. Grain modifying conditions and adjustments, sub-paragraphs (3) and (4) and *Research Disclosure,* Vol. 367, November 1994, Item 36736.

PROBLEM TO BE SOLVED

Although the emulsions of Johnson et al represent an outstanding combination of low granularity, low intensity reciprocity failure and low pressure sensitivity, they are limited in the maximum speeds that can be realized, even though selenium is effective to offset speed losses attributable to the incorporation of iridium. Further, the highest speed levels realized are accomplished only by accepting the known disadvantages of selenium. Specifically, selenium, though added as a dopant, largely ends up at the grain surfaces, thereby competing with conventional surface chemical sensitizers. Selenium itself is toxic. In addition, selenium dopants lack stability, requiring special handling and protection from the ambient environment until actually added to the emulsion. Selenium requires care in its level and method of addition to avoid increasing fog levels. Finally, selenium is not well tolerated environmentally, making disposal of unused selenium dopant solutions burdensome.

SUMMARY OF THE INVENTION

In one aspect this invention is directed to an emulsion comprised of a dispersing medium and radiation-sensitive silver halide grains including tabular grains (a) accounting for at least 50 percent of total grain projected area, (b) having a thickness of less than 0.3 μm, (c) containing greater than 70 mole percent bromide and at least 0.25 mole percent iodide, (d) having {111} major faces, (e) comprised of laminae located adjacent the {111} major faces each having a thickness of less than 35 nanometers and containing at least 1 mole percent higher iodide than a host portion of the tabular grains on which they are deposited, (f) containing a combination of an iridium dopant capable of reducing low intensity failure and a speed enhancing dopant, wherein (g) the speed enhancing dopant is comprised of a Group 8 metal ion chosen from among $Fe^{+2}$, $Ru^{+2}$ and $Os^{+2}$ and at least one coordination ligand more electron withdrawing than fluoride ion, (h) the Group 8 dopant is present in a concentration of from 20 to 300 molar parts per million in interior regions of the tabular grains accounting for up to 90 percent of total silver, and (i) the iridium dopant and at least 20 molar parts per million of the Group 8 dopant are restricted to separate portions of the tabular grains separated by an intervening portion accounting for at least 10 percent of total silver forming the tabular grains.

It has been discovered that, if properly located within the tabular grains in relation to grain surfaces and iridium dopants, coordination complexes of Group 8 metals chosen to provide shallow electron trapping sites are capable of offering higher photographic speeds than can be obtained by employing selenium. Unlike selenium, the Group 8 metal coordination complexes form a part of the face centered cubic crystal lattice structure of the silver halide grains and are not mobile. Hence they do not wander to the surface of the grains. Additionally, these coordination complexes avoid or reduce the varied disadvantages of selenium, discussed above.

DESCRIPTION OF PREFERRED EMBODIMENTS

The emulsions of the invention are capable of meeting and exceeding the highest performance standards previously realized in camera speed photographic emulsions.

The emulsions of the invention can be realized by doping during their precipitation conventional tabular grain emulsions in which the tabular grains (a) account for at least 50 percent of total grain projected area, (b) have a thickness of less than 0.3 μm, (c) contain greater than 70 mole percent bromide and at least 0.25 mole percent iodide, (d) have {111} major faces, and (e) are comprised of laminae located adjacent the {111} major faces each having a thickness of less than 35 nanometers and containing at least 1 mole percent higher iodide than a host portion of the tabular grains on which they are deposited, Tabular grain emulsions satisfying criteria (a) through (e) have performance capabilities that meet and in many instances exceed those of other tabular grain emulsions. These emulsions are illustrated by Solberg et al U.S. Pat. No. 4,433,048, Piggin et al U.S. Pat. Nos. 5,061,609 and 5,061,616, and Chang et al U.S. Pat. Nos. 5,314,793 and 5,360,703, the disclosures of which are here incorporated by reference.

(a)

Criterion (a) requires that at least 50 percent of total grain projected area be accounted for by tabular grains. It is usually preferred that at least 70 percent and most preferably at least 90 percent of total grain projected area be accounted for by tabular grains. Under well controlled conditions tabular grain emulsions in which the tabular grains account for substantially all (i.e., 97% or more) of total grain projected area can be prepared.

(b)

Turning to criterion (b), the tabular grains counted in satisfaction of criterion (a) each have an average thickness of less than 0.3 μm, preferably less than 0.2 μm.

(c)

For camera speed films it is generally contemplated that the tabular grains contain at least 0.25 (preferably at least 1.0) mole percent iodide. Although the saturation level of iodide in a silver bromide crystal lattice is generally cited as about 40 mole percent and is a commonly cited limit for iodide incorporation, for photographic applications iodide concentrations seldom exceed 20 mole percent and are typically in the range of from about 1 to 12 mole percent.

The halide in the tabular grains that is not iodide can be entirely bromide or a combination of bromide and chloride. It is contemplated that bromide will in every instance be present in the tabular grains in a concentration of at least 70 mole percent, based on silver. Wey et al U.S. Pat. No. 4,414,306 and Delton U.S. Pat. No. 5,372,927 each disclose techniques for incorporating significant amounts of chloride into high (>70 mole %) bromide tabular grain emulsions. The tabular grain preparation technique of Wey et al can be employed to form the tabular grains prior to laminae formation while the techniques of Delton are compatible with the laminae forming techniques of Piggin et al, cited above. When both bromide and iodide are at their lowest permissible concentrations, the chloride, of course, forms the balance of the halide. However, it is preferred to maintain chloride ion concentrations at less than 20 mole percent and most preferably less than 10 mole percent.

(d)

Although tabular grain emulsions are known in which the major faces of the tabular grains lie in {100} crystal planes, the only tabular grain emulsions that have been investigated in connection with this invention are those that have major faces lying in {111} crystal planes.

(e)

The tabular grains satisfying criteria (a)–(d) additionally contain elevated iodide laminae forming their {111} major faces having a thickness of less than 35 nm (preferably less than 25 nm). The laminae contain at least a 1 mole percent, preferably at least 3 mole percent, higher iodide concentration that than the host portion of the tabular grains. The host portion of the each tabular grain is that portion that of the tabular grain that is precipitated prior to the laminae and that forms a deposition substrate for the laminae. Preferably the laminae contain no more than about 15 mole percent iodide, based on silver.

Solberg et al and Piggin et al, cited above, teach varied techniques for forming the laminae. The technique employed by Solberg et al improves speed-granularity relationships, with, in one alternative form, abrupt (e.g., dump) iodide addition to form the laminae resulting in the highest attainable speeds. The term "dump" is used to indicate iodide addition that is not to intentionally limited in rate. That is, dump iodide addition occurs as rapidly as possible, usually nearly instantaneously. Iodide addition at any regulated rate is referred to as run-iodide addition.

As taught by Chang et al U.S. Pat. No. 5,314,793, there is clear evidence that tabular grain emulsions produced by run-iodide and dump-iodide approaches exhibit differing crystal lattice structures. When a tabular silver iodobromide grain prepared entirely by run-iodide addition is cooled to <10° K (6° K being herein selected for specific comparisons) and stimulated with 325 nm wavelength electromagnetic radiation (e.g., with a helium cadmium laser), a single stimulated emission peak is observed in the wavelength range of from 490 to 650 nm. While the exact wavelength of maximum emission varies somewhat, depending upon iodide levels, the shape of the emission curves are quite similar. This suggests that in forming the crystal lattice of tabular grains by the run-iodide approach iodide ions have been accommodated within the silver bromide crystal lattice structure.

On the other hand, when the tabular grains are formed by the dump-iodide approach, stimulation as described above at 325 nm can result, depending on iodide content, in a second distinguishable wavelength emission mode. Generally dump iodide in an amount sufficient to account for at least 1 mole percent iodide, based on total silver in the tabular grain, is required to produce an emission intensity at 575 nm that is at least one third the emission intensity maximum in the wavelength region of from 490 to 560 nm based on identical stimulations to 325 nm radiation. In other words, at this level of dump-iodide a discernible longer wavelength shoulder is in evidence on the stimulated emission profile of the tabular grains. With dump iodide levels of 3.5 percent or more, based on overall tabular grain silver, a second stimulated emission peak is present at or near 575 nm so that 575 nm the intensity of emission is at least 90 percent of (and in most instances exceeds) the intensity of the emission peak in the wavelength region of from 490 to 560 nm. The 575 nm stimulated emission intensity provides unequivocal evidence of crystal lattice modification by the dump-iodide approach and provides a conveniently used analytical tool by which higher imaging efficiency tabular grains can be identified.

Studies on the dump-iodide tabular grain structures produced by Solberg et al indicate that crystal lattice dislocations at the edges of the tabular grains are primarily responsible for increased speed.

While Piggin et al is also concerned with obtaining efficient speed-granularity relationships, Piggin et al forms laminae within therein stated pAg and temperature boundaries to enhance the invariance of tabular grain response as a function of locally applied pressure. It is believed that the laminae techniques of Piggin et al enhance sensitivity invariance as a function of locally applied pressure by annealing crystal lattice defects from the major faces the tabular grains.

By maintaining a high level of edge dislocations in the tabular grains and a low level of face dislocations it is possible to achieve both high levels of imaging efficiency and low levels of pressure sensitivity in tabular grain emulsions. Pressure sensitivity has been particularly noted in tabular grains having mean ECD's of 2.0 μm or more. Superior tabular grain emulsions having both high levels of speed in relation to granularity and high levels of invariance to the localized application of pressure are those that have a mean ECD of at least 2.0 μm and satisfy the relationship:

$$(P+F)\times ECD>5.0 \quad (I)$$

where

P represents the percentage of the tabular grains containing at least 10 dislocations in the peripheral regions of the tabular grains, F represents the percentage of the tabular grains containing at least 10 dislocations in the central regions of the tabular grains, and ECD is the mean equivalent circular diameter of the grains in micrometers.

Dopants

An iridium dopant capable of reducing low intensity reciprocity failure is incorporated in the tabular grains of the emulsion of the invention. Specific examples of iridium dopants employed to reduce low intensity reciprocity failure are contained in Kim U.S. Pat. No. 4,449,751 and Johnson U.S. Pat. No. 5,164,292, the disclosures of which are here incorporated by reference. A more general survey of iridium dopants employed to reduce reciprocity failure and for other purposes is provided by B. H. Carroll, "Iridium Sensitization: A Literature Review", *Photographic Science and Engineering,* Vol. 24, No. 6, November/December 1980, pp. 265–267. A still more general survey of dopants, including iridium dopants intended to reduce reciprocity failure is provided in *Research Disclosure,* Vol. 365, September 1994, Item 36544, Section I. Emulsion grains and their preparation, D. Grain modifying conditions and adjustments, subparagraphs (3) and (4). Any conventional iridium dopant known to reduce low intensity reciprocity failure can be employed in any amount known to be useful for this purpose in the practice of the invention.

In a specifically preferred form the iridium dopant is incorporated in the crystal lattice structure of the grain in the form a hexacoordination complex satisfying the formula:

$$[Ir^{+3}X_5L']^m \quad (II)$$

where

X is a halide ligand,

L' is any bridging ligand, and m is −2 or −3.

As the iridium is added during precipitation a convenient counter ion, such as ammonium or alkali metal, is associated with the hexacoordination complex, but only the anionic portion of formula II is actually incorporated within the crystal lattice structure. Also, as introduced, the iridium can be in a +4 valence state, as illustrated, for example by Leubner et al U.S. Pat. No. 4,902,611. However, the +4 iridium reverts to the +3 valence state upon incorporation. Chloride and bromide are preferred halide ligands. The bridging ligand L' can also be a halide ligand or, alternatively, can take any convenient conventional form, including any of the various individual ligand forms disclosed in McDugle et al U.S. Pat. Nos. 4,933,272, 4,981,781 and 5,037,732, Marchetti et al U.S. Pat. No. 4,937,180, Keevert et al U.S. Pat. No. 5,037,732 and Olm et al U.S. Pat. No. 5,360,712, the disclosures of which are here incorporated by reference.

The iridium dopant is preferably introduced following precipitation of at least 20 (most preferably 60) percent of the silver forming the tabular grains and before 90 (most preferably 80) of the silver forming the tabular grains has been precipitated. The ideal location for the iridium dopant is at or near the interface of the host portions of the tabular grains and the laminae.

Preferred concentrations of the iridium dopant can range up to about 800 (most preferably 140) molar parts per billion (mppb). Minimum effective iridium concentrations of 2.8 mppb have been reported, although concentrations of at least about 15 mppb are usually more convenient to use.

Although iridium can reduce or eliminate low intensity reciprocity failure, it produces a significant reduction in photographic speed. It has been discovered that it is possible to actually raise the speed of the emulsion to higher levels than is possible in the absence of dopants.

This has been achieved by employing within identified concentration levels and tabular grain locations, in relation to the tabular grain surfaces and the iridium dopant, a speed enhancing Group 8 dopant comprised of a divalent Group 8 metal (i.e., $Fe^{+2}$, $Ru^{+2}$ or $Os^{+2}$) and at least one coordination ligand more electron withdrawing than a fluoride ion. The speed enhancing Group 8 dopant can be introduced as a hexacoordination complex satisfying the formula:

$$[ML_6]^n \quad \text{(III)}$$

where

M is a divalent Group 8 cation (i.e., $Fe^{+2}$, $Ru^{+2}$ or Os+2),

L represents six coordination complex ligands which can be independently selected, provided that at least four of the ligands are anionic ligands and at least one the ligands is more electronegative than any halide ligand (i.e., more electron withdrawing than a fluoride ion, which is the most electronegative halide ion), and n a is negative integer having an absolute value of less than 5.

At least four of the ligands are required to be anionic to facilitate incorporation of the dopant into the crystal lattice structure of the tabular grains. The remaining two ligands can also be anionic or can take any convenient conventional neutral form, such as carbonyl, aquo or ammine ligands.

Although only one of the ligands is required to be more electronegative than a halide ion, any higher number, up to and including all of the ligands can be more electronegative than a halide ion. One common way of assessing electron withdrawing characteristics is by reference to the spectrochemical series of ligands, derived from the absorption spectra of metal ion complexes in solution, referenced in *Inorganic Chemistry: Principles of Structure and Reactivity*, by James E. Huheey, 1972, Harper and Row, New York and in *Absorption Spectra and Chemical Bonding in Complexes* by C. K. Jorgensen, 1962, Pergamon Press, London. From these references the following order of ligands in the spectrochemical series is apparent:

$$I^- < Br^- < S^{-2} < \underline{S}CN^- < Cl^- < NO_3^- < F^- < \underline{O}H < ox^{-2} < H_2\underline{O} < \underline{N}CS^- < CH_3C\underline{N}^- < \underline{N}H_3 < en < dipy < phen < \underline{N}O_2^- < phosph \ll \underline{C}N^- < \underline{C}O.$$

The abbreviations used are as follows: ox=oxalate, dipy=dipyridine, phen=o-phenathroline, and phosph=4-methyl-2,6,7-trioxa-1-phosphabicyclo[2.2.2]octane. The spectrochemical series places the ligands in sequence in their electron withdrawing properties, the first ($I^-$) ligand in the series is the least electron withdrawing and the last (CO) ligand being the most electron withdrawing. The underlining indicates the site of ligand bonding to the polyvalent metal ion. The efficiency of a ligand in providing the electron withdrawing characteristic needed for speed enhancement increases as the ligand atom bound to the metal changes from Cl to S to O to N to C. Thus, the ligands $\underline{C}N^-$ and $\underline{C}$ are especially preferred. Other preferred ligands are thiocyanate ($\underline{N}CS^-$), selenocyanate ($\underline{N}CSe^-$), cyanate ($\underline{N}CO^-$), tellurocyanate ($\underline{N}CTe^-$) and azide ($N_3^-$).

When the metal M in the hexacoordination complex is $Fe^{+2}$, it is preferred that at least five of the ligands L be more electron withdrawing than a halide ion. When the metal M in the hexacoordination complex is $Os^{+2}$ satisfactory speed enhancement is observed with only one ligand more electron withdrawing than a halide ion, but at least two such ligands are preferred. For $Ru^{+2}$ complexes it is preferred that at least three of the ligands be more electronegative than a halide ion.

The Group 8 coordination complexes when introduced can be associated with the same charge balancing counter ions as the iridium complexes, described above. Subject to the requirements noted, the ligands L can be selected from the same conventional ligands as L', described above (i.e., from any of the various individual ligand forms disclosed in McDugle et al U.S. Pat. Nos. 4,933,272, 4,981,781 and 5,037,732, Marchetti et al U.S. Pat. No. 4,937,180, Keevert et al U.S. Pat. No. 5,037,732 and Olm et al U.S. Pat. No. 5,360,712, the disclosures of which are here incorporated by reference).

The following are specific illustrations of Group 8 coordination complex dopants capable of enhancing speed when employed in combination with iridium dopants:

| | |
|---|---|
| SET-1 | $[Fe(CN)_6]^{-4}$ |
| SET-2 | $[Ru(CN)_6]^{-4}$ |
| SET-3 | $[Os(CN)_6]^{-4}$ |
| SET-4 | $[Fe(pyrazine)(CN)_5]^{-4}$ |
| SET-5 | $[RuCl(CN)_5]^{-4}$ |
| SET-6 | $[OsBr(CN)_5]^{-4}$ |
| SET-7 | $[FeCO(CN)_5]^{-3}$ |
| SET-8 | $[RuF_2(CN)_4]^{-4}$ |
| SET-9 | $[OsCl_2(CN)_4]^{-4}$ |
| SET-10 | $[Ru(CN)_5(OCN)]^{-4}$ |
| SET-11 | $[Ru(CN)_5(N_3)]^{-4}$ |
| SET-12 | $[Os(CN)_5(SCN)]^{-4}$ |
| SET-13 | $[Fe(CN)_3Cl_3]^{-3}$ |
| SET-14 | $[Ru(CO)_2(CN)_4]^{-1}$ |
| SET-15 | $[Os(CN)Cl_5]^{-4}$ |

It is contemplated to employ from 20 to 300 (preferably 25 to 100) molar parts per million (mppm) of the Group 8 dopant in interior regions of the tabular grains accounting for up to 90 percent of total silver. Stated another way, sufficient Group 8 dopant to satisfy the concentration ranges stated above is separated from the surfaces of the tabular grains by at least 10 percent of total silver. Best results are not realized when the Group 8 dopant is buried too deeply within the grains, particularly as the concentration of the dopant is increased. It is therefore preferred that the Group 8 dopant be introduced into the tabular grains after at least 50 percent of total silver forming the tabular grains has been precipitated when concentrations of greater than 100 mppm are employed.

The Group 8 dopant relied upon for speed enhancement can be introduced before or after the iridium dopant. To realize the speed advantages contemplated by this invention iridium dopant incorporation can be completed before Group 8 dopant is introduced or Group 8 dopant introduction can be completed before iridium dopant introduction is begun and at least 10 percent (preferably at least 20 percent) of the total silver forming the tabular grains is precipitated between completing addition of one dopant and before introduction of the remaining dopant. Any Group 8 dopant that overlaps the iridium dopant does not detract from the performance of the iridium dopant, but in areas of overlap the Group 8 dopant is ineffective to increase speed. Therefore, even if the Group 8 dopant is not completely separated from the iridium dopant by its grain placement, at least the effective concentrations of the Group 8 dopant stated above are contemplated to be separated by the iridium dopant by 10 or, preferably, 20 percent of total silver, as noted above.

Thus, whereas Johnson et al U.S. Pat. No. 5,164,292 states that selenium and iridium dopants can be added at any time in the formation of the silver halide grains, the location of the Group 8 dopant and its proper position relative to the iridium dopant are both necessary conditions for speed enhancement.

The tabular grain emulsion features not discussed above can take any convenient conventional form. For example, the mean ECD of the emulsion grains can range up to the highest photographically useful levels (typically stated to be about 10 μm), although in practice tabular grain photographic emulsions seldom employ mean ECD's of greater than 5 μm and most typically exhibit mean ECD's of less than 3 μm. The emulsions can be either polydisperse or monodisperse. It is generally preferred that the emulsions be relatively monodisperse with the coefficient of variation (COV) of grain ECD being less than 30 percent, where COV is standard grain deviation (σ) divided by mean ECD with the quotient multiplied by 100.

The tabular grain emulsions contain a dispersing medium, typically including a hydrophilic colloid peptizer, such as gelatin or a gelatin derivative. Conventional dispersing media for photographic emulsions are summarized in *Research Disclosure,* Item 36544, cited above, Section II. Vehicles, vehicle extenders, vehicle-like addenda and vehicle related addenda. A further summary of conventional photographic emulsion features, photographic element features, exposures and processing is provided in dispersing media for *Research Disclosure,* Item 36544, cited above.

EXAMPLES

The invention can be better appreciated by consideration in conjunction with the specific embodiments.

Emulsions 1–20

Each of the emulsions in this series contained $AgBr_{95.9}I_{4.1}$ tabular grains exhibiting a mean equivalent circular diameter of 2.7 μm and a mean thickness of 0.13 μm. The tabular grains accounted for greater than 90 percent of total grain projected area. Each of the tabular grains were formed with $AgBr_{95.9}I_{4.1}$ host portions and silver iodobromide laminae formed by the abrupt (dump) addition of iodide.

The aqueous solutions in Table I were employed.

TABLE I

| | |
|---|---|
| Solution A: | |
| Gelatin (bone) | 10 g |
| NaBr | 30 g |
| Antifoamant | 1.3 mL |
| $H_2O$ | to give a volume of 5000 ml |
| Solution B: | |
| 0.393N $AgNO_3$ | 534 mL |
| Solution C: | |
| 2N NaBr | 746 mL |
| Solution D: | |
| 5.95 g $(NH_4)_2SO_4$ | at water to 350 mL |
| Solution E: | |
| 2.5N NaOH | 40 mL |
| Solution F: | |
| 4N $HNO_3$ | 25 mL |
| Solution G: | |
| gelatin (bone) | 140.14 g |
| $H_2O$ | to give a volume of 1820 mL |
| a surfactant | |
| Solution H: | |
| 2.709N NaBr | 3646 mL |
| 0.0413N KI | |
| Solution I: | |
| 2.75N $AgNO_3$ | 4310 mL |
| Solution J: | |
| 154 g NaBr | add water to 817 mL |
| Solution K: | |
| AgI | 0.36 mole |
| gelatin (bone) | 14.4 g |
| $H_2O$ | to give a volume of 753 mL |
| Solution L: | |
| gelatin (bone) | 301.2 g |
| $H_2O$ | 1186.4 g |
| a biocide | |
| Solution M: | |
| $K_4Ru(CN)_6$ | 5 to 100 mL $H_2O$ and dopant as needed to give desired dopant concentration |
| Solution N: | |
| $K_2IrCl_6$ | 5 to 100 mL $H_2O$ acidified with nitric acid and dopant as needed to give desired dopant concentration |

Emulsion 1, an undoped control emulsion was prepared as follows:

Solution A was added to the reaction vessel and controlled at a temperature of 40° C. Stirring of the reaction vessel was provided. The pH of the solution in the reaction vessel was adjusted to 6. The temperature was then raised to 65° C., and solutions B and C were added at rates of 64 mL/min and 15.3 mL/min, respectively for 1 minute. Solution D was then added to the reaction vessel. One minute later, Solution E was added. One and a half minutes later, Solution F was added. One minute later, Solution G was added. Five minutes after the addition of Solution G, Solutions B and H were added at rates of 87 mL/min and 14.3 mL/min for 5 minutes while pAg was controlled at 9.07.

Solutions I and H were added, with continued pAg control for the times and rates given below:

| Step | Solution I flow rate (mL/min) | Solution H flow rate (mL/min) | Time |
|---|---|---|---|
| a | 15 increasing linearly to 40 | 16.2 increasing linearly to 42.2 | 25 |
| b | 40 increasing linearly to 98.1 | 42.2 increasing linearly to 102.3 | 31 |

Solution J was then added. Two minutes later, solution K was added. Solution I was then added at a rate of 50 ml/min over a period of 24 minutes while solution C was used to control the pAg at 8.17. The emulsion was cooled to 40° C. and washed until it reacted a pAg of 8.22 when it was concentrated. Solution L was then added and the emulsion was chilled until set while stirring.

The remaining emulsions of this series were prepared similarly as Emulsion 1, except that dopant Solutions M and/or N were added by one of the following methods:

| | |
|---|---|
| Method (i) | Added to a portion of Solution H and added during the portion(s) of Step a and/or b necessary to dope the desired fraction of each emulsion grain.* |
| Method (ii) | Added from an aqueous solution at either a constant (c) or ramped (r) flowrate through the portion of the precipitation necessary to dope the desired volume fraction of each emulsion with the desired dopant concentration profile. |
| Method (iii) | Incorporated into the AgI seeds used in Solution K at some fraction denoted by x–y%. |
| Method (iv) | Added to Solution J. |

Table II identifies the levels, placements and methods of addition of dopants employed in the preparation of each of the emulsions of this series.

TABLE II

| Emulsion | Dopant (Conc.) | Dopant Placement: From x% to y% of total Ag | Site of Dopant* | Method of addition |
|---|---|---|---|---|
| 1 | 0 | — | — | |
| 2 | $[Ru(CN)_6]^{4-}$ (50 mppm) | 17.9 to 22.9 (in early part of host) | host | i |
| 3 | $[Ru(CN)_6]^{4-}$ (100 mppm) | 68.5 to 71.6 (in early part of laminae) | lam | iii |
| 4 | $[Ru(CN)_6]^{4-}$ (50 mppm) | 71.6 to 76.6 (in early part of laminae) | lam | ii |
| 5 | $[Ru(CN)_6]^{4-}$ (50 mppm) | 66.5 to 68.5 (in late part of host) | host | i |
| 6 | $[Ru(CN)_6]^{4-}$ (100 mppm) | 68.5 (between host and laminae) | betw. | iv |
| 7 | $[IrCl_6]^{2-}$ (27 mppb) | 64.5 to 66.5 (in late part of host) | host | ii |
| 8 | $[Ru(CN)_6]^{4-}$ (50 mppm) | 66.5 to 68.5 (in late part of host) | host | i |
| | $[IrCl_6]^{2-}$ (27 mppb) | 62.5 to 64.5 (in late part of host) | host | ii |
| 9 | $[Ru(CN)_6]^{4-}$ (50 mppm) | 63.5 to 68.5 (in late part of host) | host | i |
| | $[IrCl_6]^{2-}$ (27 mppb) | 64.5 to 66.5 (in late part of host) | host | ii |
| 10 | $[Ru(CN)_6]^{4-}$ (50 mppm) | 64.5 to 66.5 (in late part of host) | host | i |
| | $[IrCl_6]^{2-}$ (27 mppb) | 63.5 to 68.5 (in late part of host) | host | ii |
| 11 | $[Ru(CN)_6]^{4-}$ (50 mppm) | 66.5 to 68.5 (in late part of host) | host | i |
| | $[IrCl_6]^{2-}$ (27 mppb) | 66.5 to 68.5 (in late part of host) | host | ii |
| 12 | $[Ru(CN)_6]^{4-}$ (50 mppm) | 64.5 to 66.5 (in late part of host) | host | i |
| | $[IrCl_6]^{2-}$ (27 mppb) | 63.5 to 68.5 (in late part of host) | host | ii |
| 13 | $[Ru(CN)_6]^{4-}$ (50 mppm) | 64.5 to 66.5 (in late part of host) | host | i |
| | $[IrCl_6]^{2-}$ (27 mppb) | 63.5 to 68.5 (in late part of host) | host | ii |
| 14 | $[Ru(CN)_6]^{4-}$ (50 mppm) | 64.5 to 66.5 (in late part of host) | host | i |
| | $[IrCl_6]^{2-}$ (27 mppb) | 63.5 to 68.5 (in late part of host) | host | ii |
| 15 | $[Ru(CN)_6]^{4-}$ (50 mppm) | 17.9 to 22.9 (in early part of host) | host | i |
| | $[IrCl_6]^{2-}$ (27 mppb) | 64.5 to 66.5 (in late part of host) | host | ii |

TABLE II-continued

| Emulsion | Dopant (Conc.) | Dopant Placement: From x% to y% of total Ag | Site of Dopant* | Method of addition |
|---|---|---|---|---|
| 16 | $[Ru(CN)_6]^{4-}$ (50 mppm) | 71.6 to 76.6 (in early part of laminae) | lam | ii |
| | $[IrCl_6]^{2-}$ (27 mppb) | 64.5 to 66.5 (in late part of host) | host | ii |
| 17 | $[Ru(CN)_6]^{4}$ (50 mppm) | 63.5 to 68.5 (in late part of host) | host | i |
| | $[IrCl_6]^{2}$ (27 mppb) | 71.6 to 76.6 (in early part of laminae) | lam | ii |
| 18 | $[Ru(CN)_6]^{4}$ (50 mppm) | 63.5 to 68.5 (in late part of host) | host | i |
| | $[IrCl_6]^{2-}$ (27 mppb) | 70 to 85 (thru half of laminae) | lam | ii |
| 19 | $[Ru(CN)_6]^{4-}$ (100 mppm) | 68.5 (between host and lam) | betw | iv |
| | $[IrCl_6]^{2-}$ (27 mppb) | 64.5 to 66.5 (in late part of host) | host | ii |
| 20 | $[Ru(CN)_6]^{4-}$ (50 mppm) | 1.7 to 68.5 (thru host) | host | i |
| | $[IrCl_6]^{2-}$ (9 mppb) | 66.5 to 68.5 (in late part of host) | host | ii |

*Dopant placement type: host = added during growth of host, betw = added between growth of host and growth of laminae, lam = added during growth of laminae.

Emulsion 21

This emulsion was prepared similarly as Emulsion 16, except that $[Ru(CN)]^{4-}$ was replaced by $[SeCN]^{1-}$ added as the potassium salt. The level of the selenium dopant was 1.42 mppm and its nominal placement, based on location of addition, was as disclosed in Johnson et al 5,164,292.

Sensitizations and Evaluations

The following sensitizing dyes were used for sensitizations:

Dye 1

Anhydro-5,5'-dichloro-9 ethyl-3,3'-bis(3-sulfopropyl)thiacarbocyanine hydroxide, triethyl ammonium salt Dye 2

Andydro-9-ethyl-5,5'-dimethyl-3,3'-bis(3-sulfopropyl)thiacarbocyanine hydroxide, triethyl ammonium salt The coupler coated with these emulsions was: Coupler 1:

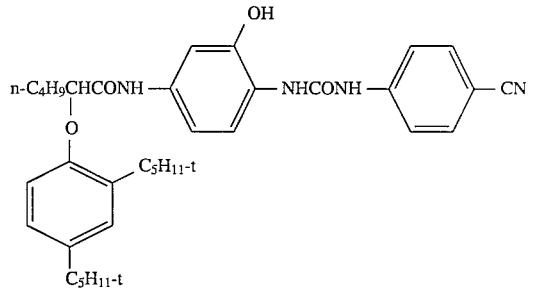

The emulsions were sensitized as follows:

A 0.25 mole sample of emulsion was melted at 40° C. Bone gelatin and water were added to bring the total gelatin level of the emulsion to 65 g/Ag mole. Next, an aqueous solution containing 120 mg/Ag mole of sodium thiocyanate was added to the emulsion. Dye 1 and Dye 2 were then added with stirring to the emulsion, in a molar ratio of 9:1 to provide a 90% monolayer coverage of the grain surfaces, and the emulsion was held for 30 minutes.

Gold and sulfur-containing chemical sensitizers, potassium aurous dithiosulfate dihydrate and sodium thiosulfate pentahydrate, were then added at levels chosen to provide substantially optimum sensitizations. Twenty mg/Ag mole of benzothiazolium tetrafluoroborate was then added and the emulsion was split into smaller portions which were digested at 60° C. for 5 to 20 minutes. The emulsion was cooled to 40° C. and additional gelatin and water were added along with 4-hydroxy-6-methyl-1,3,3a,7-tetraazaindine (Na+ salt).

Emulsions sensitized as described above were coated on a cellulose acetate photographic film support that had an antihalation backing and a gelatin subbing layer. Emulsion laydown was 1.076 g Ag/$m^2$. This layer also contained 0.969 g/$m^2$ of Coupler 1, surfactant, and a total gelatin content of 3.23 g/$m^2$. The emulsion layer was overcoated with a 2.15 g/$m^2$ gelatin layer which also contained surfactant and 1.75% by weight of bis(vinylsulfonyl) methane hardener, based on total coating gelatin.

The emulsions so coated were given 5500° K daylight balanced exposure through a calibrated neutral step tablet (0–4 density range) and through a Wratten™ 23A filter (>560 transmission).

The emulsions were then developed for 2 minutes and 15 seconds using the Kodak Flexicolor™ C41 color negative process.

The photographic responses are reported in Table III. Speed is reported in relative log speed units. Each unit difference in relative speed represents 0.01 log E, where E represents exposure in lux-seconds. Speed measurements were based on samples exposed for 0.01 second with speed being contrast corrected—that is, measured at a toe density $D_s$, where $D_s$ minus $D_{min}$ equals 20 percent of the slope of a line drawn between $D_s$ and a point D' on the characteristic curve offset from $D_s$ by 0.6 log E.

Low intensity reciprocity failure (LIRF) was based on differences in speed measured at a density of 0.15 above $D_{min}$ resulting from equal exposures, but with exposure times varied between 0.0001 and 1 second.

TABLE III

| Emulsion | Relative Log Speed/Dmin | LIRF |
|---|---|---|
| 1 | 240/07 | −15 |
| 2 | 246/08 | −20 |
| 3 | 250/07 | −11 |
| 4 | 245/07 | −28 |
| 5 | 250/08 | −12 |
| 6 | 245/08 | −12 |
| 7 | 236/10 | +1 |
| 8 | 239/09 | −2 |
| 9 | 241/09 | +3 |
| 10 | 242/08 | −2 |
| 11 | 239/10 | −3 |
| 12 | 241/09 | +3 |
| 13 | 239/09 | −2 |
| 14 | 240/08 | −1 |
| 15 | 250/09 | −4 |
| 16 | 240/09 | +3 |
| 17 | 246/09 | −5 |
| 18 | 242/08 | −9 |
| 19 | 236/10 | 0 |
| 20 | 254/09 | −7 |
| 21 | 239/08 | +3 |

Emulsion 1 was undoped. It provides a reference for speed and LIRF for judging the effects of the dopant or dopants present in the remaining emulsions.

Emulsions 2–6 were doped with only ruthenium. In every instance the speed of the emulsions was improved as compared to Emulsion 1, but LIRF remained high. On average LIRF was −16.6. Thus, the Group 8 dopant was not effective to reduce LIRF.

Emulsion 7 was doped with only iridium. LIRF was reduced, but speed was also reduced.

Emulsions 8–14 were doped with ruthenium and iridium, with the locations of the dopants within the grains overlapping. LIRF was reduced, but speed remained essentially similar to that of Emulsion 1. In other words, the ruthenium dopant compensated for the speed loss imparted by the iridium dopant, but no significant increase in speed was realized.

Emulsions 16–19 were doped with ruthenium and iridium sequentially, but with the amount of silver precipitated separating the dopant additions ranging from 1.5 to 5.5 percent. The performance reported is essentially similar to that reported for overlapping dopant additions.

Emulsion 15 separated the iridium and ruthenium dopants by the intervening precipitation of 31 percent of the total silver. LIRF was low and the speed of the emulsion was significantly higher than that of any other emulsion prepared containing iridium as a dopant. Emulsion 15 demonstrates that Group 8 dopants as herein defined are capable of significantly increasing the speed of the tabular grain emulsions by this invention while allow realizing the benefits of low levels of LIRF imparted by iridium doping.

Emulsion 20 completely overlapped the iridium dopant with the ruthenium dopant, but separated an effective amount of the ruthenium from the iridium. The speed enhancement was similar to that of Emulsion 15 while LIRF was reduced.

Emulsion 21 substituted selenium as a dopant for the ruthenium dopant in Emulsion 15. LIRF improvements are maintained, attributable to the iridium, but the speed increase realized by the invention Emulsion 15 was lost. This demonstrates the limited value of selenium as a dopant and its clear inferiority to the Group 8 dopant when placed within the crystal lattice as required by this invention. Further, it is demonstrates the speed increasing effect of the Group 8 dopant could not be predicted from observations of selenium and iridium dopant combinations.

The invention has been described in detail with particular reference to preferred embodiments thereof, but it will be understood that variations and modifications can be effected within the spirit and scope of the invention.

What is claimed is:

1. An emulsion comprised of a dispersing medium and radiation-sensitive silver halide grains including tabular grains (a) accounting for at least 50 percent of total grain projected area, (b) having a thickness of less than 0.3 μm, (c) containing greater than 70 mole percent bromide and at least 0.25 mole percent iodide, (d) having {111} major faces, (e) comprised of laminae located adjacent the {111} major faces each having a thickness of less than 35 nanometers and containing at least 1 mole percent higher iodide than a host portion of the tabular grains on which they are deposited, and (f) containing a combination of an iridium dopant capable of reducing low intensity failure and a speed enhancing dopant wherein (g) the speed enhancing dopant is comprised of a divalent Group 8 dopant chosen from among $Fe^{+2}$, $Ru^{+2}$ and $Os^{+2}$ and at least one ligand more electron withdrawing than fluoride ion, (h) the Group 8 dopant is present in a concentration of from 20 to 300 molar parts per million in interior regions of the tabular grains accounting for up to 90 percent of total silver, and (i) the iridium dopant is located in one portion of the tabular grains and at least 20 molar parts per million of the Group 8 dopant are restricted to another portion of the tabular grains separated from the one portion by an intervening portion accounting for at least 10 percent of total silver forming the tabular grains.

2. An emulsion according to claim 1 wherein the iridium dopant is present in a region of the tabular grains formed after precipitation of the first 20 percent of silver and before precipitation of the final 10 percent of silver.

3. An emulsion according to claim 2 wherein the iridium dopant is present in a region of the tabular grains formed after precipitation of the first 60 percent of silver and before precipitation of the final 20 percent of silver.

4. An emulsion according to claim 1 wherein the speed enhancing dopant is present in a concentration of from 25 to 100 molar parts per million, based on silver.

5. An emulsion according to claim 1 wherein the intervening portion accounts for at least 20 percent of the total silver forming the tabular grains.

6. An emulsion according to claim 1 wherein silver halide forming the tabular grains consists essentially of silver iodobromide.

7. An emulsion according to claim 1 wherein the speed enhancing dopant is comprised of $Os^{+2}$ and at least one cyano ligand.

8. An emulsion according to claim 1 wherein the speed enhancing dopant is comprised of $Ru^{+2}$ or $Os^{+2}$ and at least three cyano ligands.

9. An emulsion according to claim 1 wherein the speed enhancing dopant is comprised of $Fe^{+2}$, $Ru^{+2}$, or $Os^{+2}$ and at least five cyano ligands.

* * * * *